US007527511B1

(12) United States Patent
Peng et al.

(10) Patent No.: US 7,527,511 B1
(45) Date of Patent: May 5, 2009

(54) CONNECTOR FOR FLEXIBLE PRINTED CIRCUIT BOARD

(75) Inventors: Yung-Chi Peng, Taipei Hsien (TW); Ning-Lang Cheng, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/118,128

(22) Filed: May 9, 2008

(51) Int. Cl.
*H01R 13/15* (2006.01)

(52) U.S. Cl. ..... 439/260; 439/495

(58) Field of Classification Search ..... 439/260, 439/495

See application file for complete search history.

(56) References Cited

U.S. PATENT DOCUMENTS

| | | | | |
|---|---|---|---|---|
| 5,501,610 | A * | 3/1996 | Ikemoto | 439/498 |
| 6,250,966 | B1 * | 6/2001 | Hashimoto et al. | 439/631 |
| 6,508,661 | B1 * | 1/2003 | Yu | 439/495 |
| 6,589,068 | B2 * | 7/2003 | Yu | 439/495 |
| 7,112,079 | B2 | 9/2006 | Miura et al. | |
| 2003/0104721 | A1 * | 6/2003 | Yu | 439/495 |
| 2005/0260885 | A1 * | 11/2005 | Lu | 439/495 |
| 2006/0172590 | A1 * | 8/2006 | Yamada et al. | 439/495 |
| 2006/0178039 | A1 * | 8/2006 | Chen | 439/495 |
| 2006/0281353 | A1 * | 12/2006 | Suzuki et al. | 439/260 |
| 2006/0292911 | A1 * | 12/2006 | Ning | 439/260 |
| 2007/0010126 | A1 * | 1/2007 | Kim | 439/495 |
| 2007/0093122 | A1 * | 4/2007 | Kudo et al. | 439/495 |
| 2007/0117451 | A1 * | 5/2007 | Yokoyama | 439/495 |
| 2007/0134975 | A1 * | 6/2007 | Shin | 439/495 |
| 2007/0202736 | A1 * | 8/2007 | Takashita | 439/495 |
| 2008/0050966 | A1 * | 2/2008 | Hashiguchi et al. | 439/495 |
| 2008/0113542 | A1 * | 5/2008 | Sunaga | 439/260 |

* cited by examiner

*Primary Examiner*—Ross N Gushi
(74) *Attorney, Agent, or Firm*—WPAT, P.C.; Anthony King

(57) ABSTRACT

A flexible printed circuit board connector includes an insulating housing defining two insertion spaces which are opposite to each other and separated by a partition therebetween and two groups of terminal slots defined by and corresponding to the respective insertion spaces. A pair of covers engages in a rotatable manner with the insulating housing for covering the respective insertion spaces, and two groups of terminals are respectively disposed in the two groups of terminal slots of the insulating housing.

7 Claims, 7 Drawing Sheets

CONNECTOR FOR FLEXIBLE PRINTED CIRCUIT BOARD

BACKGROUND OF THE INVENTION

1. Field of the Invention

The present invention generally relates to a connector, and more particularly to a flexible printed circuit board connector (also known as FPC connector).

2. The Related Art

In electronic industry, flexible printed circuit boards are widely applied in many kinds of electronic devices due to their high flexibility and thin structure. Accordingly, connectors for connecting the flexible printed circuit boards to other electrical components of the electronic devices are mass-employed.

Conventionally, an example of a flexible printed circuit board connector usually called a FPC connector for short and disclosed in U.S. Pat. No. 7,112,079 includes an insulating housing formed with a FPC inserting space, a plurality of terminals loaded in parallel relationship with a predetermined pitch between every two of the adjacent terminals in the insulating housing, and an upper cover disposed above the FPC inserting space of the insulating housing and capable of moving between an open position for allowing insertion of a flexible printed circuit board into the insulating housing and a closed position where the upper cover presses the flexible printed circuit board against conductive contacts of the terminals. However, in order to match the property request of some compact electronic device, the number of the terminals of the FPC connector needs to be increased correspondingly. On condition that the pitch between every two of the adjacent terminals that are mounted in the insulating housing maintains unchangeable, the length of the FPC connector will inevitably become too long to be adapted for the compact electronic device. Hence, an improved FPC connector is required to overcome the disadvantage of the conventional FPC connector.

SUMMARY OF THE INVENTION

Accordingly, an object of the present invention is to provide a flexible printed circuit board connector with an improved structure adapted for a compact electronic device. The flexible printed circuit board connector includes an insulating housing defining two insertion spaces which are opposite to each other and separated by a partition therebetween, and two groups of terminal slots defined by and corresponding to the respective insertion spaces. A pair of covers engages in a rotatable manner with the insulating housing for covering the respective insertion spaces, and two groups of terminals are respectively disposed in the two groups of terminal slots of the insulating housing.

As described above, the advanced flexible printed circuit board connector has the two opposite insertion spaces for two flexible printed circuit boards being inserted in. The flexible printed circuit board connector not only satisfies the property request of the compact electronic device but also reduces the length thereof.

BRIEF DESCRIPTION OF THE DRAWINGS

The present invention will be apparent to those skilled in the art by reading the following description of a preferred embodiment thereof, with reference to the accompanying drawings, in which.

DETAILED DESCRIPTION OF THE PREFERRED EMBODIMENT

Figure 1:
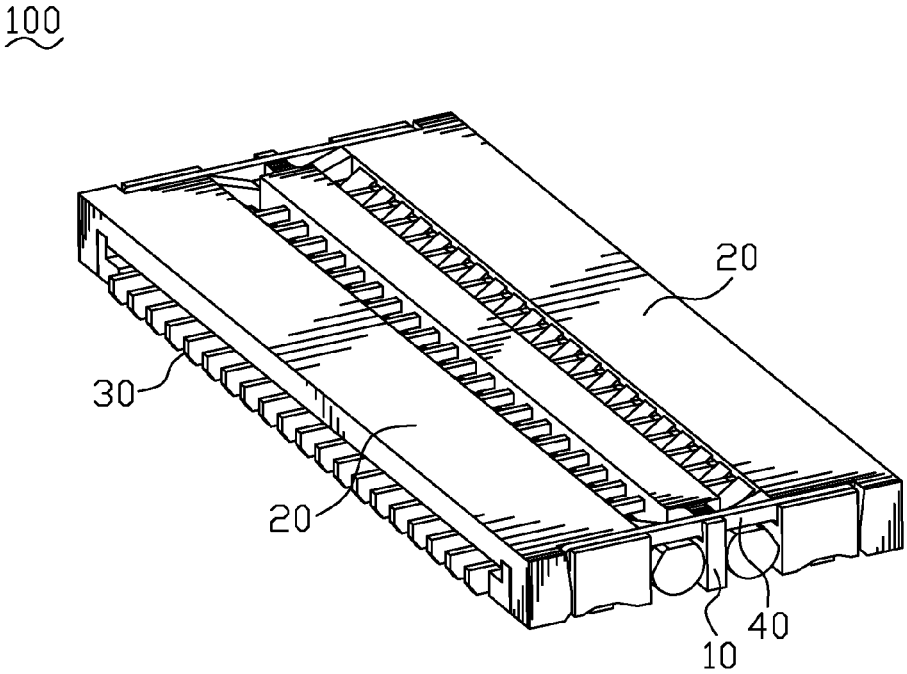
FIG. 1 is a perspective view of a flexible printed circuit board connector in accordance with the present invention.
Figure 2:
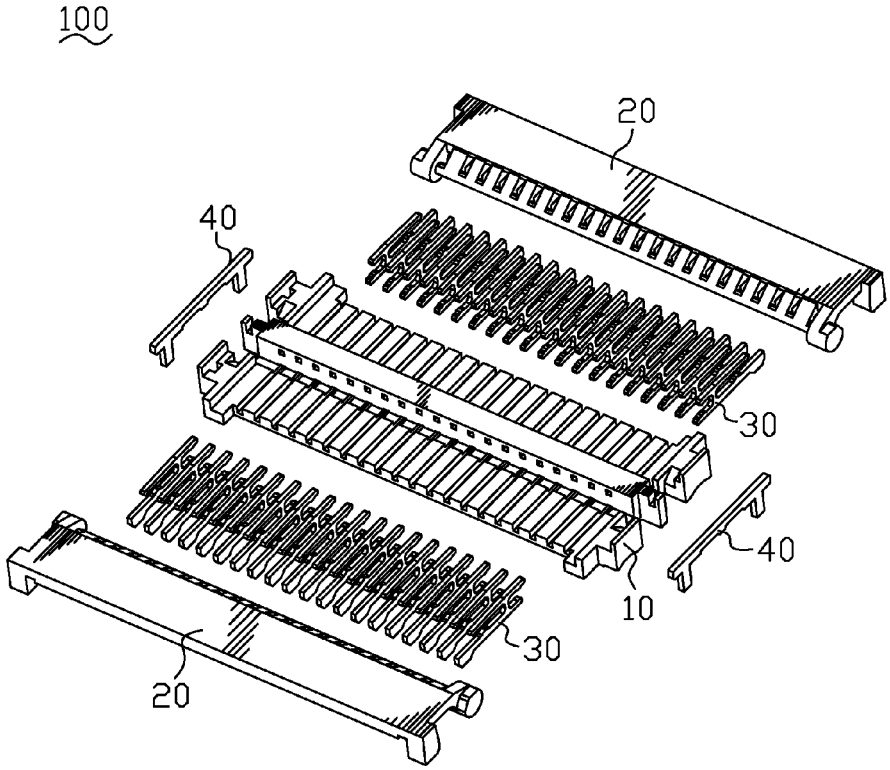
FIG. 2 is an exploded view of the flexible printed circuit board connector shown in FIG. 1 and viewed from another perspective.

Referring to FIG. 1 and FIG. 2, a flexible printed circuit board connector 100 usually called a FPC connector for short in accordance with the present invention includes an insulating housing 10, two rotating covers 20 pivotally and symmetrically disposed on the front and rear portions of the insulating housing 10, two groups of terminals 30 mounted symmetrically in the front and rear portions of the insulating housing 10 for electrically connecting two flexible printed circuit boards 50 (shown in FIG. 9) with a printed circuit board (PCB) of an electrical device (not shown), and a pair of retaining components 40 mounted in the insulating housing 10 and fixed on the electrical device for locating the FPC connector 100 on the electrical device steadily.

Figure 3:
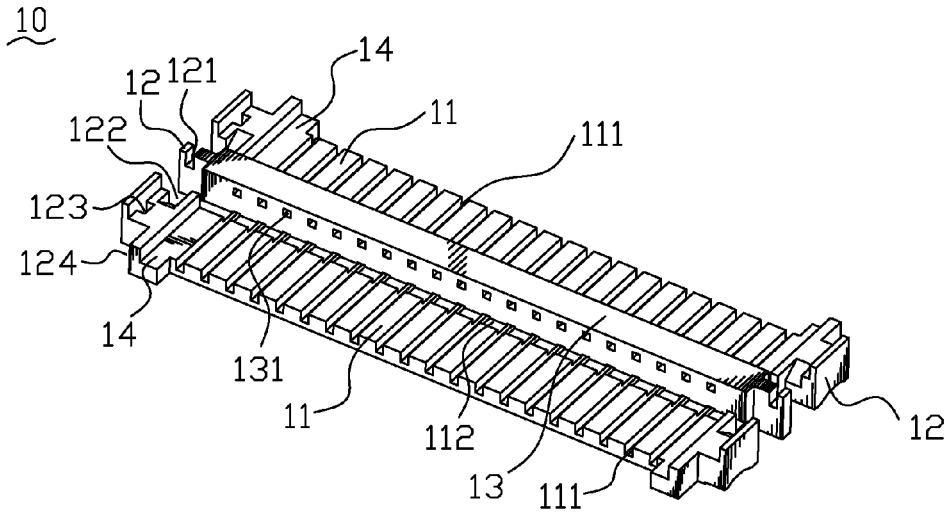
FIG. 3 is a perspective view of an insulating housing of the flexible printed circuit board connector.

With reference to FIG. 2 and FIG. 3, the insulating housing 10 of the FPC connector 100 is substantially rectangular and disposed transversely. The insulating housing 10 has a basic body 11, two sidewalls 12 extending laterally and upwardly from opposite sides of the basic body 11 respectively and a partition 13 protruding transversely from the middle portion of the basic body 11 for symmetrically dividing the basic body 11 into two parts in the front-to-rear direction (as used herein, the direction perpendicular to length direction of the connector). Then the basic body 11, the two sidewalls 12 and the partition 13 collectively define two insertion spaces 14 therebetween respectively facing the front and the rear directions for the two flexible printed circuit boards 50 (see FIG. 9) being inserted therein. Because the front part and the rear part of the basic body 11 separated by the partition 13 have the same structure, then just the front part of the basic body 11 will be described in detail herein. The front part of the basic body 11 longitudinally defines a plurality of terminal slots 111 in parallel relationship with a predetermined pitch between every two of the adjacent terminal slots 111. The terminal slots 111 each extend to pass through the front of the basic body 11 and also partially extend into the partition 13. A locating groove 112 is transversely defined on the front part of the basic body 11 and adjacent to a front side of the partition 13. The locating groove 112 passes through the basic body 11 and the two sidewalls 12 and communicates with the terminal slots 111. Each of the sidewalls 12 longitudinally defines a receiving cavity 121 passing therethrough. The sidewall 12 defines two accommodating holes 122 at the front portion and the rear portion thereof and the two accommodating holes 122 are separated by the sidewall 12 connecting with the center portion of the partition 13. Each of the accommodating holes 122 passes through the top and bottom and the outer side of the sidewall 12 and communicates with the locating groove 112 of the basic body 11. The sidewall 12 defines two receiving apertures 123 passing through the top and bottom thereof. The two receiving apertures 123 are respectively positioned at the front and the rear of the accommodating holes 122 of the sidewall 12. Two receiving gaps 124 are respectively defined at the foremost and rearmost portions of the sidewall 12. The front side and a rear side of the partition 13 respectively define a plurality of fixing caves 131 at the top portions thereof and correspondingly facing the terminal slots 111 defined on the front part and the rear part of the basic body 11.

Figure 4:
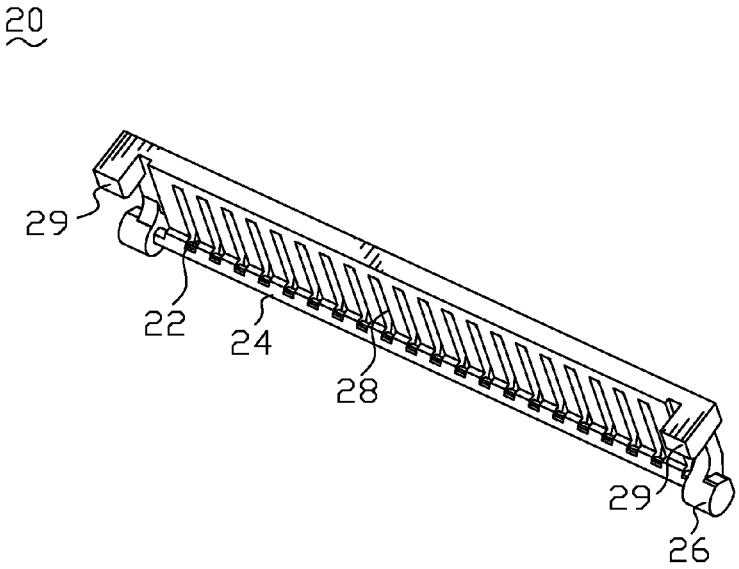
FIG. 4 is a perspective view of one of two rotating covers of the flexible printed circuit board connector.

Referring to FIG. 2 and FIG. 4, each of the two rotating covers 20 is in rectangular shape and has a pressing arm 24 transversely defined at the rear portion of the rotating cover 20. A plurality of propping recesses 22 is parallel defined on the top and rear of the rotating cover 20. A bottom surface of the rotating cover 20 defines a plurality of receiving recesses 28. Two substantially circular cam shafts 26 protrude outward from opposite sides of the pressing arm 24. Two buckling blocks 29 protrude downward from the front end portion of the rotating cover 20.

Figure 7:
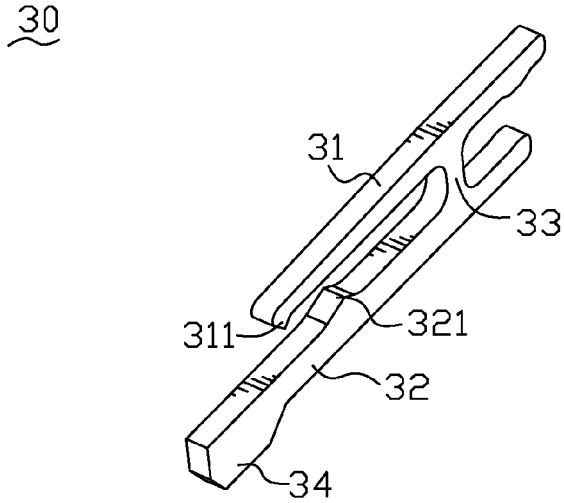
FIG. 7 is a perspective view of a terminal of the flexible printed circuit board connector.

With reference to FIG. 2 and FIG. 7, the terminal 30 substantially formed in H-shape has an upper arm 31, a lower arm 32, a connecting arm 33 connecting the upper arm 31 and the lower arm 32 together to form a H-shape. A front tip of the upper arm 31 protrudes downwardly to form an upper contact portion 311. A lower contact portion 321 protrudes upwardly upon the nearly middle portion of the lower arm 32. A front tip of the lower arm 32 protrudes downwardly to from a soldering portion 34.

Figure 6:
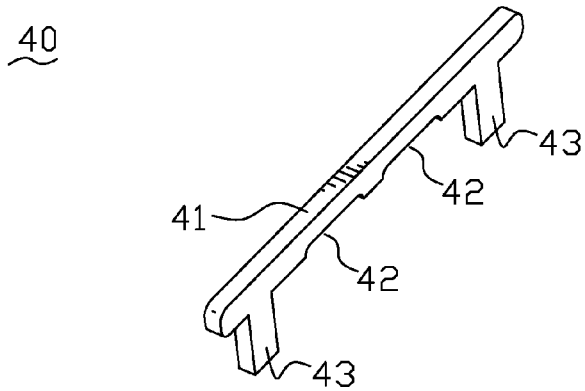
FIG. 6 is a perspective view of one of two retaining components of the flexible printed circuit board connector.

Referring to FIG. 2 and FIG. 6, each of the retaining components 40 has a basic strip 41. A bottom surface of the basic strip 41 defines two notches 42. The front portion and the rear portion of the basic strip 41 respectively protrude downward to form a locating nail 43.

Figure 5:
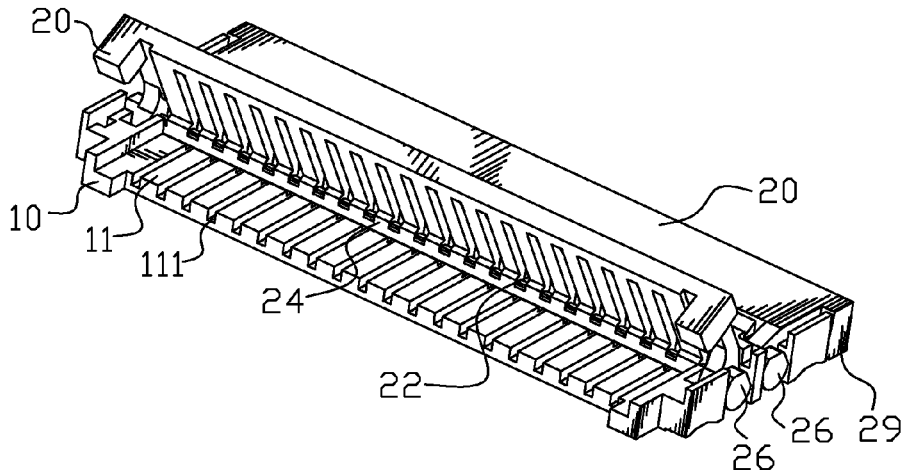
FIG. 5 is an assembly perspective view of the insulating housing and the rotating covers with one of the rotating covers being in open state.
Figure 8:
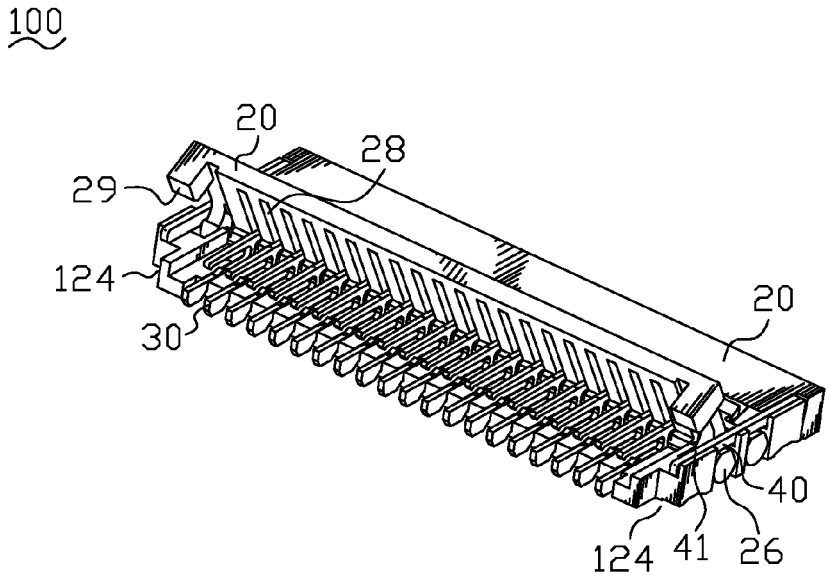
FIG. 8 is an assembly perspective view of the flexible printed circuit board connector with the rotating cover being in the open state.

Please refer to FIG. 1, FIG. 5 and FIG. 8. In assembly, the two rotating covers 20 are symmetrically disposed on the insulating housing 10 and cover the two insertion spaces 14. The pressing arm 24 of the rotating cover 20 is placed in the locating groove 112 of the basic body 11. The two cam shafts 26 of the rotating cover 20 are respectively received in the accommodating holes 122 defined in the opposite sidewalls 12 respectively. The two buckling blocks 29 of the rotating cover 20 are respectively arranged in the receiving gaps 124 defined in the opposite sidewalls 12 for fastening the rotating cover 20 on the insulating housing 10. The two groups of terminals 30 are respectively disposed in the terminal slots 111 defined on the front part and the rear part of the basic body 11 of the insulating housing 10. The lower arm 32 is inserted in the terminal slot 111 of the insulating housing 10 and the upper arm 31 is received in the receiving recess 28 of the rotating cover 20. The rear portion of the upper arm 31 is inserted in the propping recess 22 of the rotating cover 20 and further inserted into the fixing cave 131 of the partition 13 formed on the basic body 11 of the insulating housing 10. The rear portion of the lower arm 32 received in the terminal slot 111 supports the pressing arm 24 so that the pressing arm 24 is confined between the rear portion of the upper arm 31 and the rear portion of the lower arm 32 and retained by the connecting arm 33 of the terminal 30. The soldering portion 34 is soldered to the PCB for electrically connecting with the PCB. The two retaining components 40 are respectively mounted in the insulating housing 10. The basic strip 41 of the retaining component 40 is placed in the receiving cavity 121. The locating nails 43 are inserted in the receiving apertures 123 and soldered on the electrical device to locate the insulating housing 10 on the electrical device. The notches 42 receive the cam shafts 26 therein.

Figure 9:
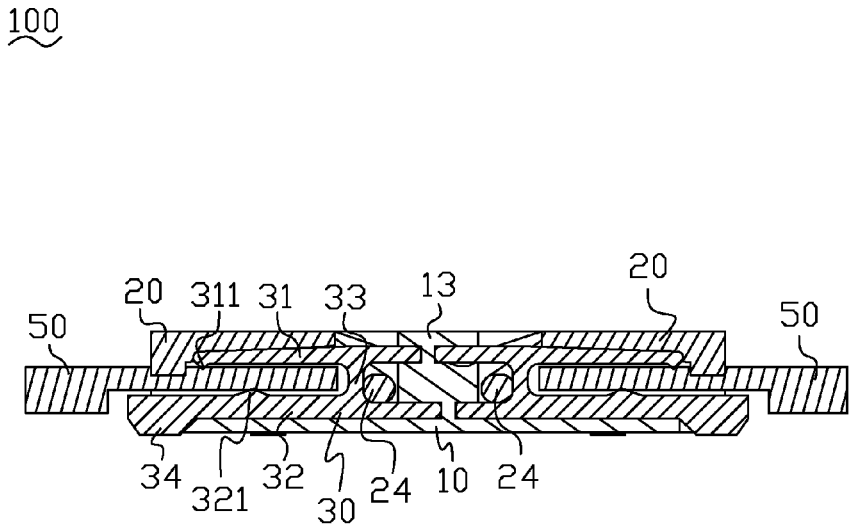
FIG. 9 is a cross-sectional view of the flexible printed circuit board connector.
Figure 10:
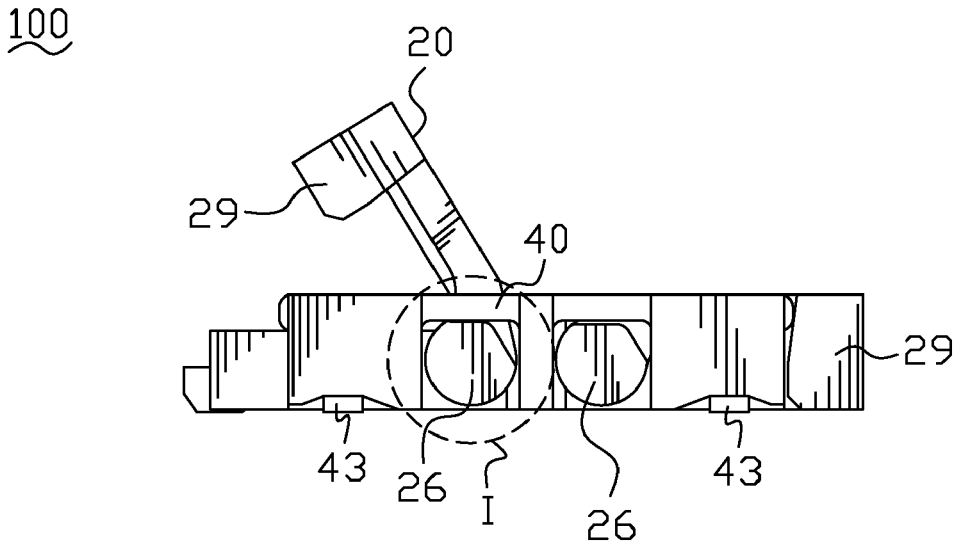
FIG. 10 is a side view of the flexible printed circuit board connector shown in FIG. 8.
Figure 11:
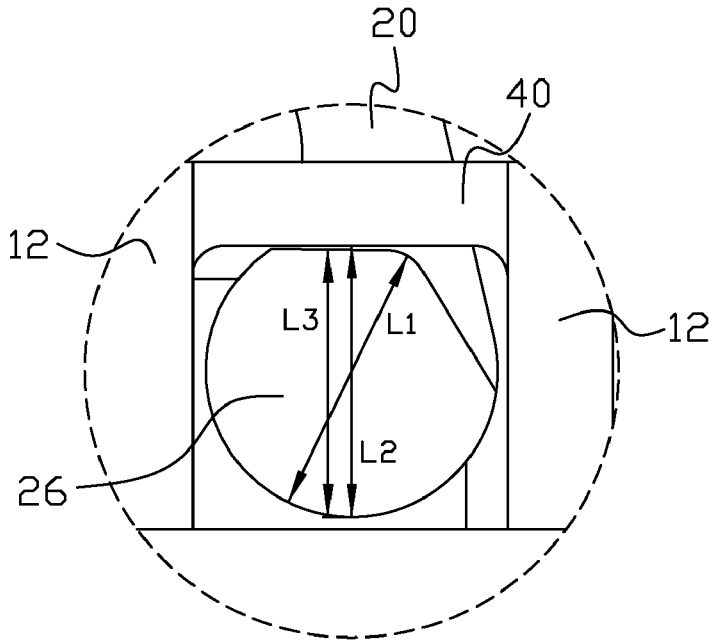
FIG. 11 is a partially enlarged view of the encircled portion labeled I of FIG. 10.

Please refer to FIG. 9, FIG. 10 and FIG. 11. The cam shaft 26 of the rotating cover 20 is cut to have two flat surfaces and a humped portion formed between the two flat surfaces and smoothly connecting with the two flat surfaces, so that the cam shaft 26 has an utmost protrudent point at the humped portion. A chord that passes the utmost protrudent point and an axle center of the cam shaft 26 is the longest chord of the cam shaft 26. The length of the longest chord of the cam shaft 26 is designated by L1 and is longer than the distance between the flat surface of the cam shaft 26 and the lowest surface of the cam shaft 26 that faces the flat surface, wherein the distance is designated by L3 which is equal to or greater than L2 represented the distance between an upper surface of the notch 42 receiving the cam shaft 26 and the lowest surface of the cam shaft 26 that faces the notch 42. While the rotating cover 20 is flipped and the cam shaft 26 is rotated in the accommodating hole 122 and the notch 42, the utmost protrudent point of the cam shaft 26 brushes past the upper surface of the notch 42. Therefore, interference is produced between the utmost protrudent point of the cam shaft 26 and the upper surface of the notch 42. In order to flip the rotating cover 20, an intended considerable force should be exerted upon the rotating cover 20 to overcome the interference. Therefore, the rotating cover 20 is opened securely and avoided being accidentally turned over to cover the insulating housing 10, which facilitates inserting or releasing the flexible printed circuit boards 50 into or from the FPC connector 100.

In use, the two flexible printed circuit boards 50 are respectively inserted in the FPC connector 100 from the front and rear directions and disposed between the upper arms 31 and the lower arms 32 of the terminals 30. The rotating covers 20 are flipped down with the buckling blocks 29 of the rotating covers 20 inserted in the receiving gaps 124 of the insulating housing 10 for tightly locking the rotating covers 20 to the insulating housing 10. The upper contact portions 311 and the lower contact portions 321 respectively defined on the upper arms 31 and the lower arms 32 are capable of contacting electric modules of the two flexible printed circuit boards 50, which avoids the flexible printed circuit boards 50 from being inserted in the FPC connector 100 in a wrong way and at the same time the upper contact portions 311 and the lower contact portions 321 clip the flexible printed circuit boards 50, which ensures that the flexible printed circuit boards 50 are disposed between the upper arms 31 and the lower arms 32 much more steadily. Thus, signal transmission between the flexible printed circuit boards 50 and the PCB of the electrical device is stable.

As described above, the advanced FPC connector 100 has the two opposite insertion spaces in which the two flexible printed circuit boards 50 are inserted from the front and rear directions. The FPC connector 100 not only satisfies the property request of the electrical device but also reduces the length thereof, so that the advanced FPC connector 100 is adapted for a compact electrical device.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A flexible printed circuit board connector, comprising:

an insulating housing defining two insertion spaces which are opposite to each other and separated by a partition therebetween, and two groups of terminal slots defined by and corresponding to the respective insertion spaces;

a pair of covers pivotably engaged with the insulating housing for covering the respective insertion spaces; and two groups of terminals respectively disposed in the two groups of terminal slots of the insulating housing.

2. The flexible printed circuit board connector as claimed in claim 1, wherein the insulating housing has a basic body and two sidewalls extending upwardly from two opposite sides of the basic body and sandwiching the two insertion spaces and the partition therebetween.

3. The flexible printed circuit board connector as claimed in claim 2, wherein the basic body defines two locating grooves respectively adjacent to a front side and a rear side of the partition, each of the covers has a pressing arm placed in the locating groove.

4. The flexible printed circuit board connector as claimed in claim 2, wherein each of the sidewalls defines two accommodating holes separated apart from each other, each of the covers has two cam shafts protruding outward from opposite sides thereof and received in the accommodating holes respectively defined in the opposite sidewalls.

5. The flexible printed circuit board connector as claimed in claim 4, wherein each of the sidewalls defines a receiving cavity passing therethrough, two retaining components are mounted in the insulating housing, each of the retaining components has a basic strip defining two notches matching the corresponding accommodating holes on a bottom surface thereof for accommodating the cam shafts, the basic strip is placed in the receiving cavity, and the notch receives the respective cam shaft.

6. The flexible printed circuit board connector as claimed in claim 5, wherein the front portion and the rear portion of the basic strip respectively protrude downwardly to form a locating nail inserted in the respective receiving aperture, each of the sidewalls defines two receiving apertures respectively positioned at the front and the rear of the accommodating holes for receiving the respective locating nail.

7. The flexible printed circuit board connector as claimed in claim 2, wherein each of the sidewalls defines a pair of receiving gaps at the foremost and rearmost portions thereof, two buckling blocks protruding downwardly from the front portion of the cover are inserted in the receiving gaps defined in the opposite sidewalls.

* * * * *